US006643479B2

(12) United States Patent
Yano

(10) Patent No.: US 6,643,479 B2
(45) Date of Patent: Nov. 4, 2003

(54) AIR DUCT, COOLING MECHANISM, AND IMAGE FORMING DEVICE INCORPORATING COOLING MECHANISM

(75) Inventor: Hidetoshi Yano, Toukai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/987,171

(22) Filed: Nov. 13, 2001

(65) Prior Publication Data

US 2002/0057920 A1 May 16, 2002

(30) Foreign Application Priority Data

Nov. 13, 2000 (JP) ..... 2000-345511

(51) Int. Cl.[7] ..... G03G 21/20
(52) U.S. Cl. ..... 399/92; 399/94
(58) Field of Search ..... 399/92–94, 320; 347/138, 152

(56) References Cited

U.S. PATENT DOCUMENTS 5,038,170 A * 8/1991 Serita ..... 399/92
5,185,629 A * 2/1993 Iino et al. ..... 399/93
5,887,226 A * 3/1999 Taki ..... 399/92
6,205,302 B1 * 3/2001 Yokota ..... 399/92
6,308,024 B1 * 10/2001 Nakayama et al. ..... 399/92 X
6,356,722 B1 * 3/2002 Kida ..... 399/92
6,438,339 B1 * 8/2002 Kaiho ..... 399/92

FOREIGN PATENT DOCUMENTS

| | | |
|---|---|---|
| JP | 9-90854 | 4/1997 |
| JP | 9-230774 | 9/1997 |
| JP | 11-194683 | 7/1999 |

* cited by examiner

*Primary Examiner*—William J. Royer
(74) *Attorney, Agent, or Firm*—Oliff & Berridge, PLC

(57) ABSTRACT

By using a duct, an image forming device in which an upper portion of a thermal fixing mechanism and an optical mechanism can be cooled. A fixing unit is disposed on the left side of the duct. A first auxiliary plate, which supports a scanner unit having a drive motor, is disposed above an upper opening of the duct. A process cartridge is disposed with its end next to the right side of the duct, and a second auxiliary plate is disposed below the duct. A power source is placed under the second auxiliary plate. Accordingly, cooling air from an intake fan is directed to four directions: between an upper portion of the fixing unit and the first auxiliary plate, to the underside of the first auxiliary plate, to the end of the process cartridge, and to the power source.

14 Claims, 8 Drawing Sheets

RIGHT SIDE VIEW

LEFT SIDE VIEW

TOP VIEW

FRONT VIEW

RIGHT SIDE VIEW

LEFT SIDE VIEW

FIG.8A
LEFT SIDE VIEW
FIG.8B
TOP VIEW
FIG.8C
RIGHT SIDE VIEW
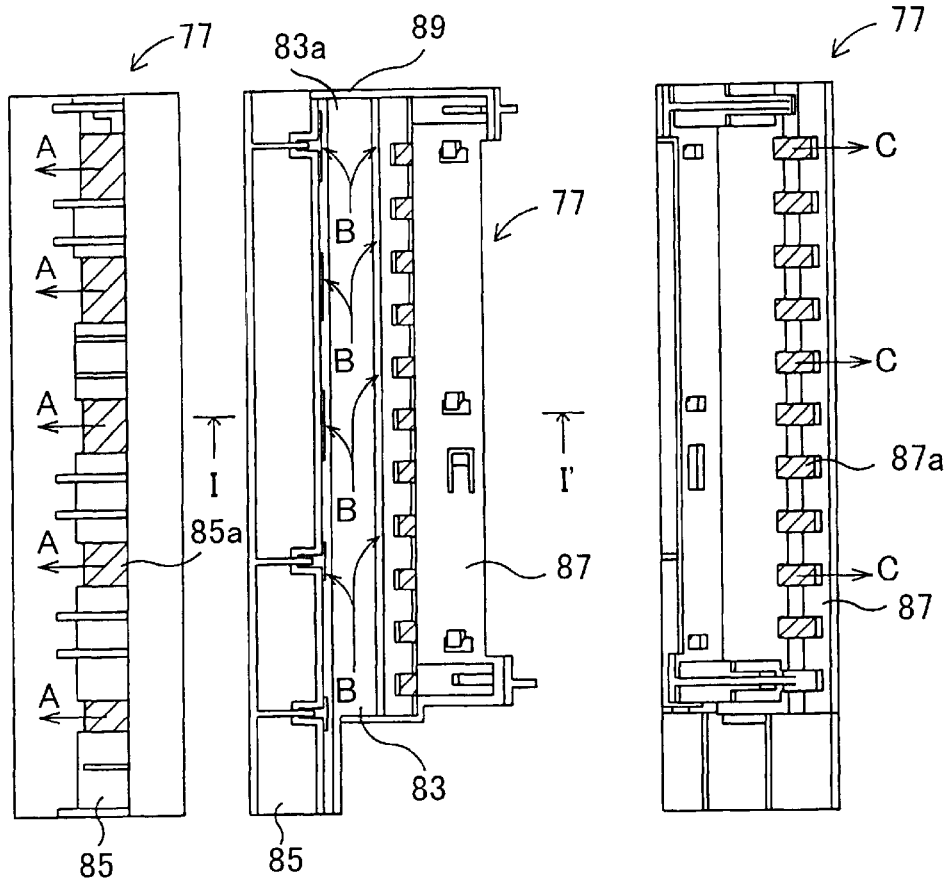
FIG.8D
FRONT VIEW
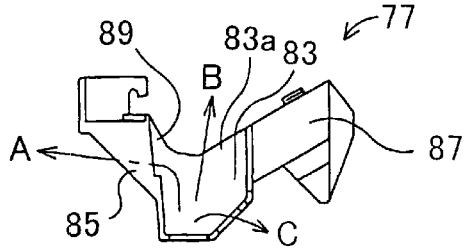
FIG.8E
I-I'
CROSS-SECTIONAL VIEW
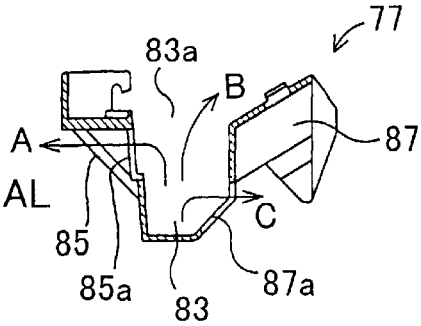

AIR DUCT, COOLING MECHANISM, AND IMAGE FORMING DEVICE INCORPORATING COOLING MECHANISM

BACKGROUND OF THE INVENTION

1. Field of Invention

The invention relates to image forming devices, such as an electrophotographic copier, an electrophotographic printer (such as a laser printer and a LED printer), a facsimile machine, and a word processor.

2. Description of Related Art

As a conventional image forming device, a laser printer that forms an image on a printing medium or a recording sheet by an electrophotographic method is known.

The electrophotographic method is executed as described below. First, a photosensitive drum whose surface is uniformly charged is selectively exposed, based on image data, to a laser beam emitted from an optical mechanism (scanner). As a result, an electrostatic latent image is defined by charged portions and non-charged portions on the photosensitive drum. The electrostatic latent image is formed based on the image data. Then, when toner (developing agent) is deposited on the electrostatic latent image (charged portions) by a developing mechanism, the electrostatic latent image on the photosensitive drum is visualized as a toner image.

Thereafter, the toner image on the photosensitive drum is transferred by a transfer roller to a recording sheet. The recording sheet with the transferred toner image is heated and pressed by a heat roller and a pressure roller. As a result, the toner image is thermally fixed onto the recording sheet. By now, image forming is accomplished. The remaining toner on the photosensitive drum without being transferred to the recording sheet is removed by a cleaning blade, which is pressed against the photosensitive drum, and is stored as waste toner in a waste toner box in a process cartridge.

A process cartridge is conventionally used in this type of electrophotographic image forming device. The process cartridge into which development processing units are integrated is detachably attached to a cartridge mount in the image forming device. A development processing unit typically includes a photosensitive drum, a charger that charges the photosensitive drum, and a developing roller that supplies a developing agent to the photosensitive drum.

However, some problems may arise in the above-described image forming device when the temperature of any internal mechanism rises excessively.

For example, an optical mechanism has a polygonal mirror that reflects a laser beam and a motor that rotates the polygonal mirror at extremely high speeds. If the temperature of the motor rises excessively, the life expectancy of the motor may be shortened. Especially, when a heat roller of a fixing mechanism is heated to a high temperature by a heater, the hot air heated to the considerably high temperature accumulates at the upper portion of the fixing mechanism. If the optical mechanism is affected by such hot air, the temperature of the motor will excessively rise and the life expectancy of the motor will be shortened.

As described above, the waste toner that has not been deposited on a recording sheet is stored in the process cartridge. If the temperature of the waste toner excessively rises, the waste toner may be melted and fixed to somewhere in the process cartridge, most likely to the vicinity of the cleaning blade. If the toner is melted and fixed to the cleaning blade, the cleaning ability may be deteriorated, or the toner carrying surface of the photosensitive drum may be damaged.

The internal temperature of each mechanism is conventionally controlled using a cooling fan or the like. Recently, space has been eliminated as much as possible from image forming devices toward the downsizing of image forming devices. In addition, a compact configuration of various mechanisms in a downsized image forming device is given a higher priority than a configuration of various mechanisms for the sake of cooling efficiency. Under these circumstances, sufficient cooling effects have not yet been attained so far.

SUMMARY OF THE INVENTION

To address the foregoing problems, the present invention provides an image forming device that can efficiently cool the upper portion of a thermal fixing mechanism and an optical mechanism.

According to one aspect of the invention, an image forming device includes an optical mechanism that is disposed between a pair of support frames of the image forming device and has a drive motor that drives an optical device to form an electrostatic latent image on a photosensitive body; a developing mechanism that develops the electrostatic latent image on the photosensitive body using a developing agent; a transfer mechanism that transfers a developing agent image developed on the photosensitive body by the developing mechanism to a printing medium; a thermal fixing mechanism that thermally fixes the developing agent image transferred by the transfer mechanism onto the printing medium; an intake fan provided for one of the pair of support frames brings in cooling air from the outside of the image forming device; and an air passage that guides the cooling air taken by the intake fan to the upper portion of the thermal fixing mechanism and to the optical mechanism.

In the above-described optical mechanism, an optical device, such as a polygonal mirror that reflects a laser beam is driven by a motor to form, using a laser beam, an electrostatic latent image on the photosensitive body. The electrostatic latent image on the photosensitive body is developed using a developing agent, such as a toner, by the developing mechanism provided in, for example, a process cartridge. Then, the image formed by the developing agent on the photosensitive body is transferred to a printing medium, and the transferred image is then thermally fixed onto the printing medium.

According to the present invention, the intake fan provided for one of a pair of support frames brings in cooling air from the outside of the image forming device, the cooling air is then guided though the air passage to the upper portion of the thermal fixing mechanism and to the optical mechanism. This cooling air prevents hot air rising from the thermal fixing mechanism, therefore hot air does not accumulate in the image forming device and does not reach to the optical mechanism. In addition, the cooling air can directly cool the optical mechanism.

BRIEF DESCRIPTION OF THE DRAWINGS

A preferred embodiment of the invention will be described with reference to the following figures wherein:

FIG. 8A is a left side view of a second duct;

FIG. 8B is a top view of the second duct;

FIG. 8C is a right side view of the second duct;

FIG. 8D is a front view of the second duct; and

FIG. 8E is a cross-sectional view of the second duct taken along line I–I' of FIG. 8B.

DETAILED DESCRIPTION OF PREFERRED EMBODIMENT

A preferred embodiment of an image forming device according to the invention will be described in detail with reference to the accompanying drawings. In this embodiment, a laser beam printer (laser printer) will be described as an image forming device by way of example.

Figure 1:
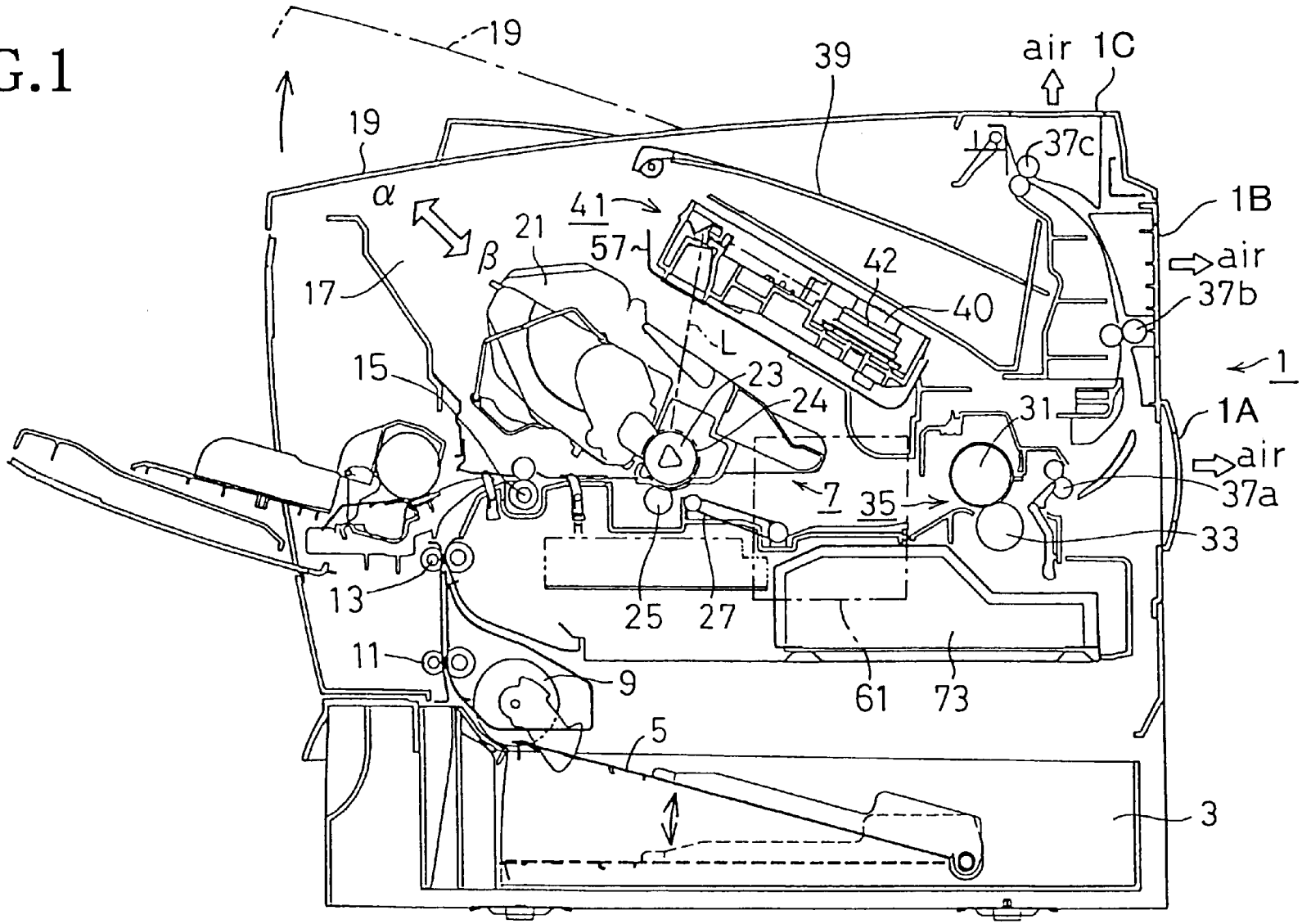
FIG. 1 is a vertical cross-sectional view showing the structure of a laser printer (main unit), as an image forming device, according to an embodiment of the invention.

Referring first to FIG. 1, the general structure of a laser printer 1, according to an embodiment of the invention, will be described. FIG. 1 is a vertical cross-sectional view showing the structure of the laser printer (main unit) 1.

As shown in FIG. 1, a sheet feed tray 3, which is detachably attached to the main unit 1, is disposed at a lower portion of the main unit 1. A support plate 5 urged upwardly by a spring (not shown) is provided in the sheet feed tray 3. Recording sheets (printing medium) are stacked on the support plate 5. A feed roller 9 is disposed above the support plate 5. A stack of recording sheets are placed on the upwardly urged support plate 5, and the uppermost sheet makes contact with the feed roller 9. As the feed roller 9 rotates while contacting the uppermost sheet, the uppermost sheet on the support plate 5 is separated from the rest of the sheets and is fed to an image forming unit 7.

Conveyor rollers 11, 13 and register rollers 15 are disposed in this order along the sheet feed path from the feed roller 9 to the image forming unit 7. The register rollers 15 are able to stop, as appropriate, to hold the leading edge of a sheet and correct the orientation of the sheet.

The image forming unit 7 has a photosensitive drum (photosensitive body) 23 having a photosensitive layer 24 on the top surface and a transfer roller (transfer mechanism) 25. The photosensitive drum 23 is disposed within a process cartridge 21. The transfer roller 25 is disposed facing the photosensitive drum 23. The photosensitive drum 23 is disposed in the process cartridge 21, while the transfer roller 25 is disposed in the main unit 1.

A fixing unit (thermal fixing mechanism) 35 is provided on the downstream side (on the right side in FIG. 1) of the image forming unit 7, across a conveyor belt 27. The fixing unit 35 has a heat roller 31 and a pressure roller 33.

Three pairs of eject rollers 37*a*–37*c* are disposed downstream of the fixing unit 35 along the sheet feed path, and a output tray 39 is provided on the upper surface of the main unit 1 to receive ejected sheets from the main unit 1 by the eject rollers 37*c*.

Disposed between the output tray 39 and the process cartridge 21 is a scanner unit (optical mechanism) 41 that scans a laser beam L over the photosensitive drum 23 to expose the photosensitive drum 23 to the laser beam L. The scanner unit 41 includes a drive motor 40, a polygonal mirror 42, and various optical devices, such as a laser diode (not shown).

Figure 2:
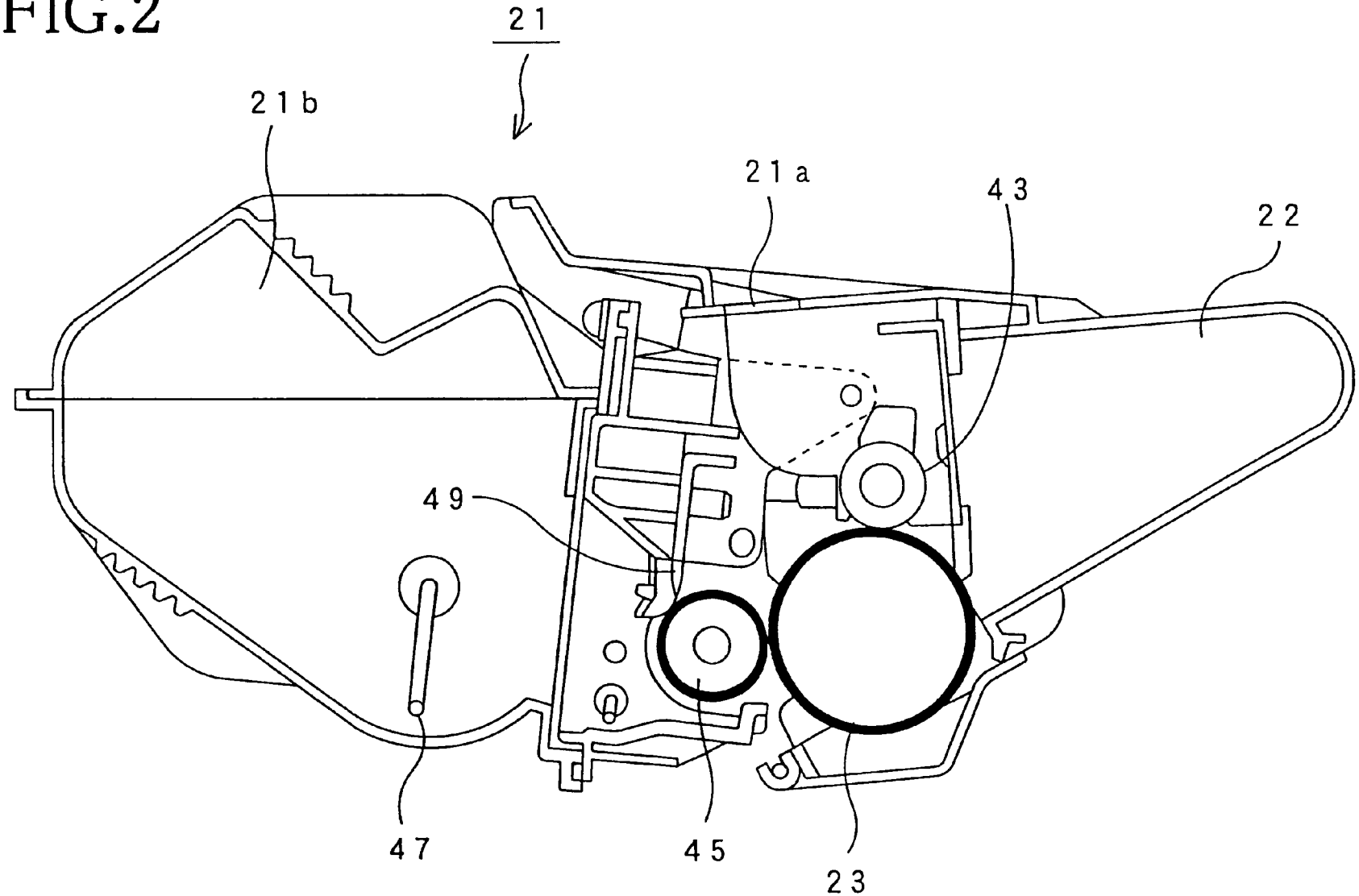
FIG. 2 is a vertical cross-sectional view showing the inner structure of a process cartridge.

Referring now to FIGS. 1 and 2, the process cartridge 21 will be described. FIG. 2 is a vertical cross-sectional view showing the inner structure of the process cartridge 21.

As shown in FIG. 1, the process cartridge 21 is detachably attached to a mounting portion 17 in the main unit 1 via an opening that is open upwardly. The upper opening of the mounting portion 17 is usually covered by a cover 19. A user opens the cover 19 by upwardly pivoting the cover 19 before mounting/removing the process cartridge 21 to/from the main unit 1. In FIG. 1, the cover 19 being pivoted is shown by a dashed line. The user removes the process cartridge 21 from the main unit 1 in the direction of arrow $\alpha$, or mounts the process cartridge 21 to the main unit 1 in the direction of arrow $\beta$.

As shown in FIG. 2, the photosensitive drum 23 having a photosensitive layer 24 on its top surface is rotatably provided in the process cartridge 21. In addition, the process cartridge 21 has a charge roller 43 that uniformly electrically charges the surface of the photosensitive drum 23, and a developing roller (developing mechanism) 45 that supplies toner to the charged surface of the photosensitive drum 23.

On the surface of the photosensitive drum 23 charged by the charge roller 43, an electrostatic latent image is formed by the laser beam L emitted from the scanner unit 41 via an exposure opening 21*a*. Then, when the developing roller 45 supplies toner, as a developing agent, to the surface of the photosensitive drum 23, the electrostatic latent image on the photosensitive drum 23 is developed into a toner image (visualized image).

The process cartridge 21 is also provided with a toner feed member 47, a layer thickness-regulating blade 49, and other known components. The toner feed member 47 stirs and feeds the toner stored in a toner box 21*b* to the developing roller 45. The layer thickness-regulating blade 49 frictionally charges the toner deposited on the surface of the developing roller 45 and flattens the toner to a thin layer. Waste toner that has been deposited on the photosensitive drum 23 and remains there without being used for image forming is removed from the photosensitive drum 23 by a cleaning blade (not shown) or the like, and is stored in a waste toner box 22 at one end (right end in FIG. 2) of the process cartridge 21.

Steps of image forming by the laser printer 1 according to the embodiment will now be described. As shown in FIG. 1, a sheet taken by the feed roller 9 from the sheet feed tray 3 is fed to the register rollers 15 by the conveyor rollers 11, 13. The orientation of the sheet is corrected by the register rollers 15.

Then, the sheet is fed to the image forming unit 7 and passes between the photosensitive drum 23 and the transfer roller 25. At this time, the toner deposited on the photosensitive drum 23 is transferred to the sheet, and a toner image is formed on the sheet.

The sheet having the toner image thereon is conveyed to the fixing unit 35 by the conveyor belt 27. In the fixing unit 35, the sheet is heated and pressed while being clamped by the heat roller 31 and the pressure roller 33. As a result, the toner image is thermally fixed onto the sheet as a toner image.

After that, the sheet having the fixed toner image thereon is ejected to the output tray 39 provided on the upper surface of the main unit 1 via three pairs of eject rollers 37*a*–37*c*.

Referring now to FIGS. 3–8, the structure of substantial parts of the embodiment, which is required for efficient flow of cooling air, will be described.

Figure 3:
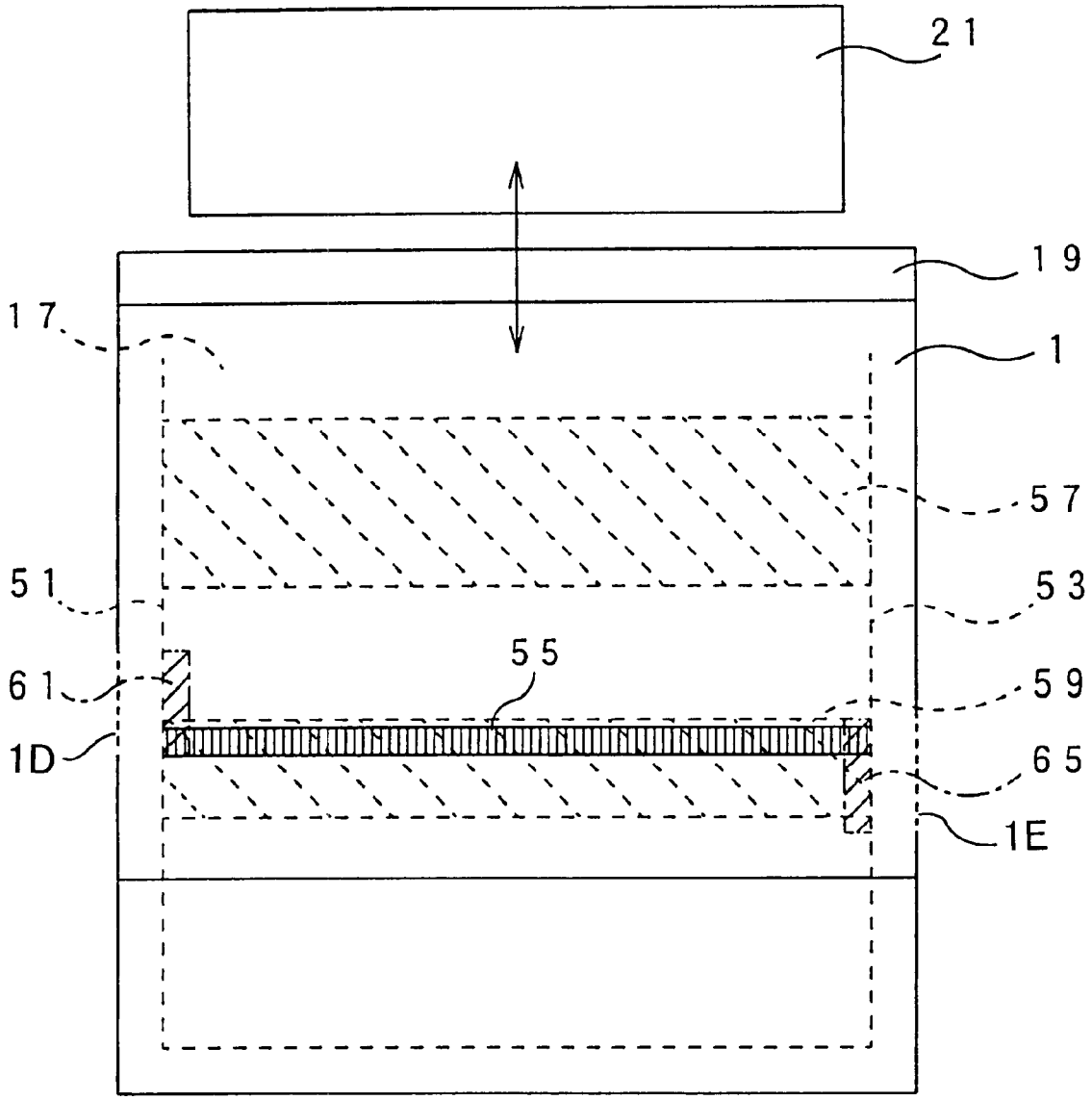
FIG. 3 is a front view of the laser printer.
Figure 4B:
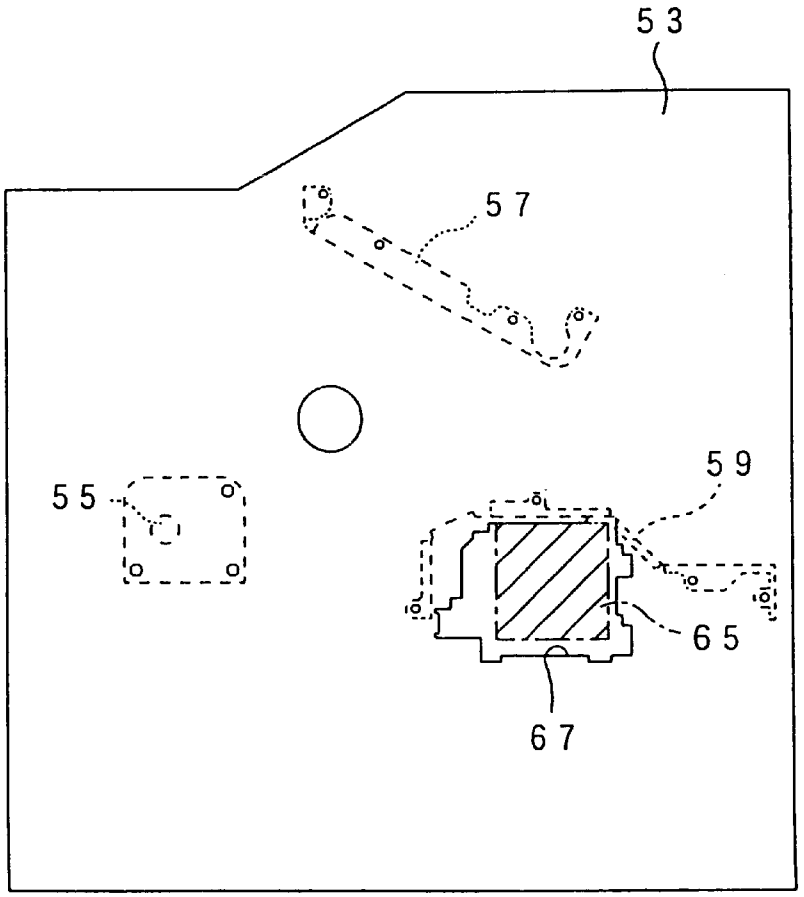
FIG. 4B is a right side view of another support frame.
Figure 4A:
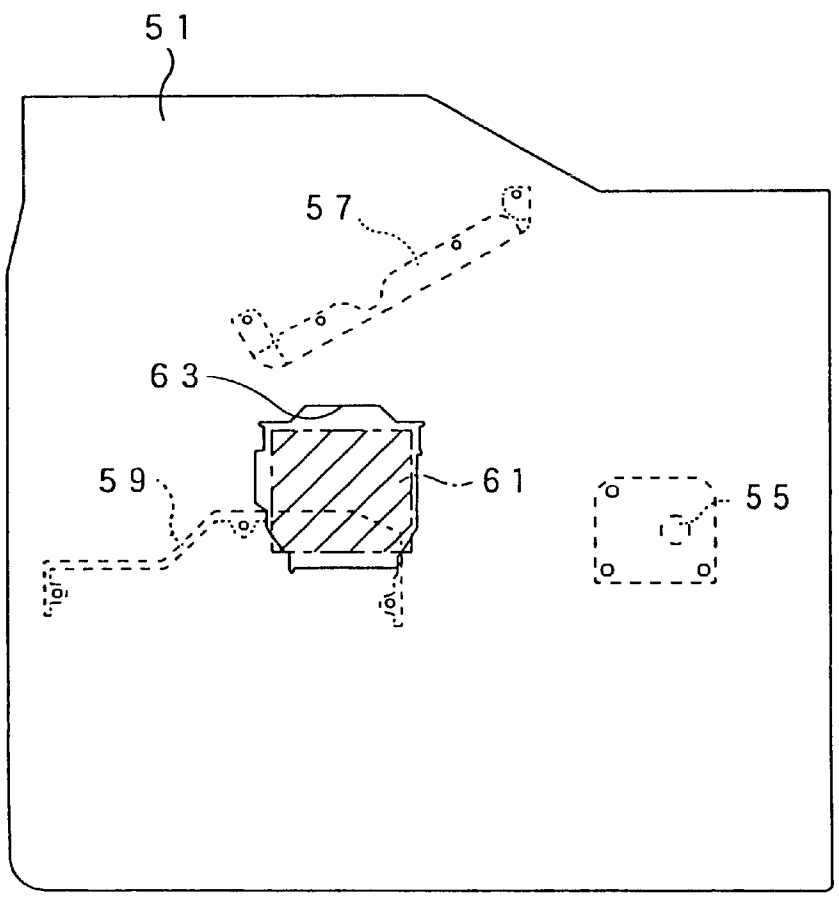
FIG. 4A is a left side view of a support frame.

FIG. 3 is a front view of the laser printer 1. FIG. 4A is a left side view of a support frame, while FIG. 4B is a right side view of another support frame. The basic configuration of the substantial parts will now be described.

As described above, according to the embodiment, the cover 19 of the main unit 1 is opened to mount the process cartridge 21 to the mounting portion 17. As shown in FIG. 3, a pair of support frames 51, 53 formed from a metal plate are vertically provided on both sides of the mounting portion 17 so as to be parallel to each other and spaced by a predetermined interval from each other.

As shown in FIGS. 3 and 4, disposed between the support frames 51, 53 is a reinforcing member 55 formed from a round metal pipe, a first auxiliary metal plate 57, and a second auxiliary metal plate 59. The reinforcing member 55 is coupled, at its both ends, to the support frames 51, 53 using screws or the likes. Accordingly, the reinforcing member 55 secures and reinforces the support frames 51, 53. The first and second auxiliary plates 57, 59 are also coupled, at their both ends, to the support frames 51, 53 using screws or the likes. The scanner unit 41 is placed on the first auxiliary plate. The second auxiliary plate 59 covers a low-voltage power source 73 (FIG. 5) that drives the drive motor 40.

As shown in FIGS. 3 and 4A, an intake fan 61 is attached to the inner side of the left support frame 51 to blow cooling air from the outside to the inside of the main unit 1. An intake hole 63 generally as large as the intake fan 61 is formed in the support frame 51 at the mounting position of the intake fan 61. An opening 1D is formed in the main unit 1, to which the support frame 51 is internally attached, so as to be aligned with the intake hole 63 in the support frame 51. With this structure, the intake fan 61 can take air from the outside to the inside of the main unit 1.

As shown in FIGS. 3 and 4B, an exhaust fan 65 is attached to the inner side of the right support frame 53 to discharge hot air from the inside to the outside of the main unit 1. An exhaust hole 67 generally as large as the exhaust fan 65 is formed in the support frame 53 at the mounting position of the exhaust fan 65. An opening 1E is formed in the main unit 1, to which the support frame 53 is internally attached, so as to be aligned with the exhaust hole 67 in the support frame 53. With this structure, the exhaust fan 65 can discharge heated air from the inside to the outside of the main unit 1.

An area where the intake fan 61 and the intake hole 63 are located is divided by the second auxiliary plate 59 into generally two sections, as shown in FIG. 4A. Thus, air taken by the intake fan 61 into the inside of the main unit 1 through the intake hole 63 flows in two directions above and below the second auxiliary plate 59, as will be described later. On the other hand, as shown in FIG. 4B, the exhaust fan 65 and the exhaust hole 67 are located below the second auxiliary plate 59. Thus, air discharged by the exhaust fan 65 to the outside of the main unit 1 through the exhaust hole 67 is the air that has been taken by the intake fan 61 into the lower side of the second auxiliary plate 59 and has cooled the low-voltage power source 73. As is obvious from such a structure, the intake fan 61 and the intake hole 63 are located at horizontally upper positions relative to the exhaust fan 65 and the exhaust hole 67.

Figure 5:
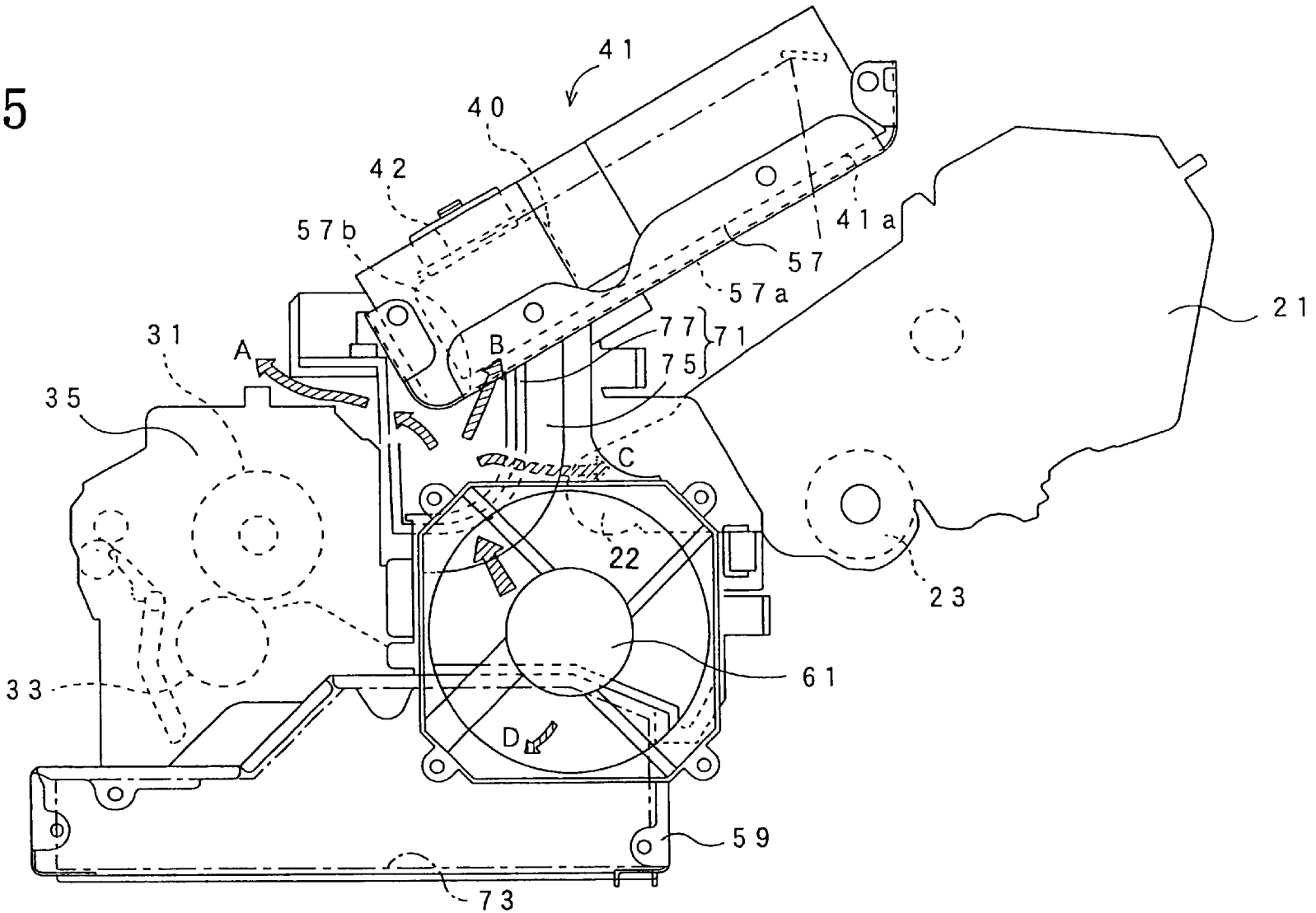
FIG. 5 illustrates an intake fan and the vicinity of an air passage as viewed from the left side.
Figure 6:
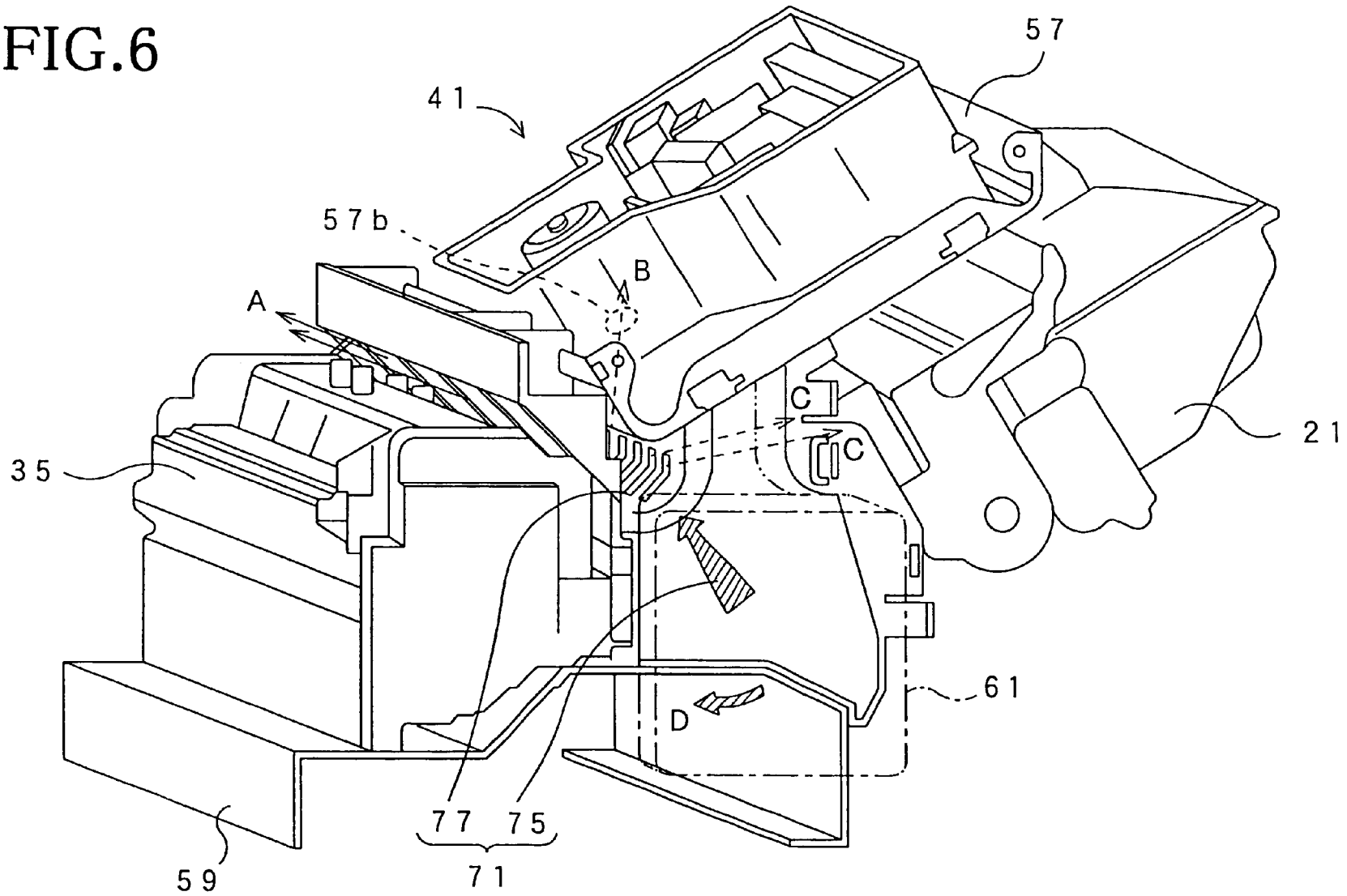
FIG. 6 illustrates the intake fan and the vicinity of the air passage as viewed from the left top side.

Referring now to FIGS. 5 and 6, an air passage will be described. FIG. 5 is a left side view of the intake fan 61 and the vicinity of an air passage. FIG. 6 is a perspective view of the intake fan 61 and the vicinity of the air passage as viewed from the top left side. As shown in FIGS. 5 and 6, an air duct 71 (hereinafter simply referred to as "duct") is disposed on the air blowing side of the intake fan 61 (on the back side of the drawing sheet of FIG. 5 or at the top left of the drawing sheet of FIG. 6), extending from the front side to the back side of the drawing sheet of FIG. 5.

The fixing unit 35 is disposed on the left side of the duct 71, which includes a first duct 75 and a second duct 77. The fixing unit 35 includes the heat roller 31 to be heated by a heater (not shown) to high temperatures and the pressure roller 33 urged against the heat roller 31. Normally, the heat roller 31 in this embodiment is heated to approximately 180° C. to 200° C. As a result, hot air heated to high temperatures is likely to accumulate at the upper portion of the fixing unit 35.

The scanner unit 41 is securely placed on the first auxiliary plate 57 at the upper portion of a top opening (second opening) 83*a* (FIG. 8B) of the duct 71. The top opening 83*a* is formed along a longitudinal direction of the duct 71.

A front portion of a base plate 57*a* of the first auxiliary plate 57 entirely closes the top opening 83*a* of the duct 71. A plurality of round openings 57*b* are formed at the front portion of the base plate 57*a* to communicate with the duct 71. Although only one opening 57*b* is shown by a broken line in FIG. 6, a plurality of openings 57*b* are actually formed. These openings 57*b* are located on the underside of a mount of the drive motor 40 of the scanner unit 41. Accordingly, as will be described later, cooling air flowing in the direction of arrow B intensively cools the underside of the mount of the drive motor 40. Normal operation over a predetermined duration is guaranteed in the drive motor 40 at ambient temperatures below 65° C., but not guaranteed at ambient temperatures above 65° C. In other words, the life expectancy of the drive motor 40 may be shortened at ambient temperatures above 65° C.

In addition, an end portion (waste toner box 22) of the process cartridge 21 has the photosensitive drum 23 that is disposed on the right side of the duct 71.

Disposed below the duct 71 is the second auxiliary plate 59 extending to a lower portion of the fixing unit 35. The low-voltage power source 73, which reaches high temperatures when used, is disposed under the second auxiliary plate 59.

Cooling air taken by the intake fan 61 from the outside to the inside of the main unit 1 flows in the directions of the arrows shown in FIG. 5 through openings formed in the duct 71. The cooling air is mainly directed to four directions: between the upper portion of the fixing unit 35 and the first auxiliary plate 57 (leftward as indicated by arrow A), to the underside of the first auxiliary plate 57 (upward as indicated by arrow B), to the end portion of the process cartridge 21 (rightward as indicated by arrow C), and to the power source 73 (in the direction of arrow D).

The structure of the duct 71, which forms the air passage, will now be described.

The duct 71 includes a first duct 75 and a second duct 77. The first duct 75 is generally planar as viewed from the front side of the drawing sheet of FIG. 5. The second duct 77 is shaped like a trough extending from the first duct 75 to the back side of the drawing sheet of FIG. 5.

Figure 7A:
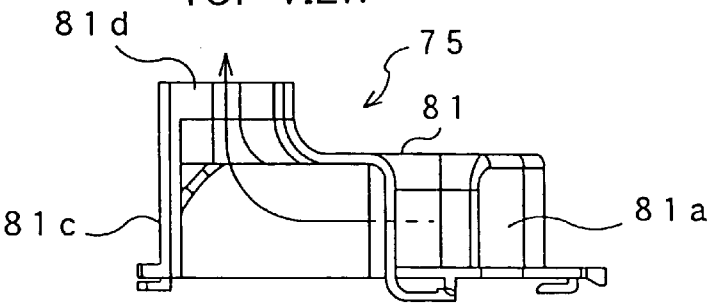
FIG. 7A is a top view of a first duct.
Figure 7C:
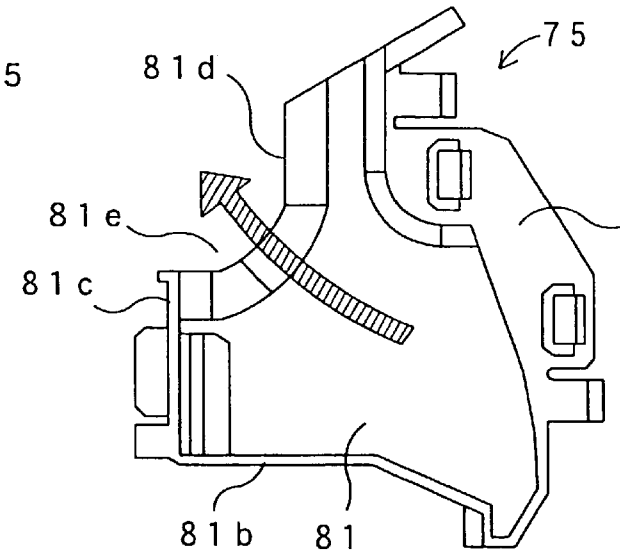
FIG. 7C is a front view of the first duct.
Figure 7D:
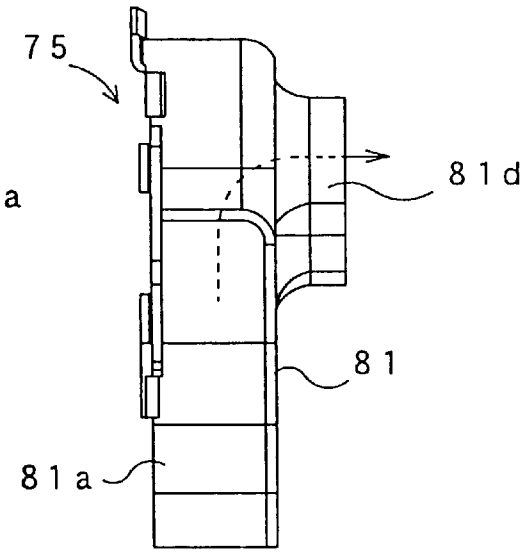
FIG. 7D is a right side view of the first duct.
Figure 7B:
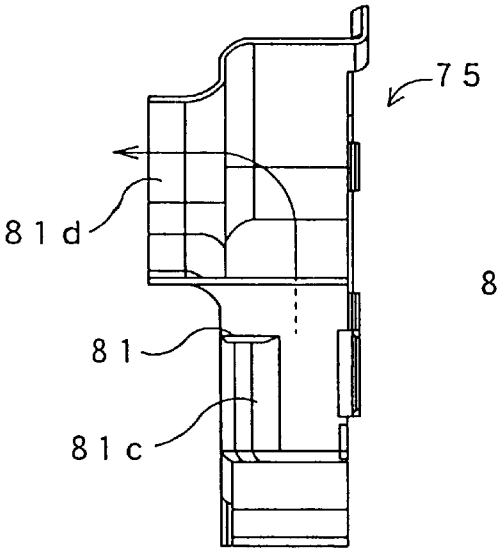
FIG. 7B is a left side view of the first duct.

As shown in FIG. 7C, the first duct 75 is generally triangular as viewed from the front. Side walls 81*a*–81*c* are provided on the right, bottom, and left sides of the generally triangular planar portion (cooling air guiding end) 81 to extend toward the front side of the drawing sheet of FIG. 7C. Additionally, a side wall 81*d* is provided at a cutout portion 81*e* at the top left portion of the first duct 75 to extend toward the back side of the drawing sheet of FIG. 7C. The first duct 75 is disposed such that its planar portion 81 faces the air blowing side of the intake fan 61. As a result, cooling air delivered to the planar portion 81 is guided to the cutout portion 81*e*.

Meanwhile, the second duct 77 is coupled to the cutout portion 81*e* of the first duct 75 and has a troughlike cylindrical body with its top open, as shown in FIG. 8B. The second duct 77 includes a troughlike midsection 83, a left frame 85 on the left side of the midsection 83, a right frame 87 on the right side of the midsection 83, and a blocking portion 89 that closes the distal end of the cylindrical body. The top opening (second opening) 83*a* is formed at the upper portion of the troughlike midsection 83. A plurality of left openings (first opening) 85*a* are formed in the left frame 85, while a plurality of right openings (third opening) 87*a* are formed in the right frame 87.

Accordingly, cooling air guided from the first duct 75 to the midsection 83 of the second duct 77 flows out through the left openings 85*a*. Then the cooling air flows in the direction of arrow A, passes between the upper portion of the fixing unit 35 and the first auxiliary plate 57, and discharges hot air accumulated at the upper portion of the fixing unit 35 to the outside of the main unit 1 through exhaust holes 1A, 1B, 1C (FIG. 1). In this way, hot air is discharged instead of being circulated within the main unit 1.

Cooling air guided to the midsection 83 of the second duct 77 flows upward (as indicated by arrow B) through the top openings (second openings) 83*a* in the midsection 83, and is guided to the underside of a bottom plate 41*a* (FIG. 5) of the scanner unit 41, especially to the underside of the mount of the drive motor 40. Then the air that has cooled the underside of the mount of the drive motor 40 is discharged to the outside through the exhaust holes 1A, 1B, 1C of the main unit 1 (FIG. 1). Clearance is created between the bottom plate 41*a* of the scanner unit 41 and a base plate 57*a* of the first auxiliary plate 57 to allow the flow of air.

In addition, cooling air guided to the midsection 83 of the second duct 77 also flows out through the right openings 87*a* in the right frame 87. The cooling air flows in the direction of arrow C, and is guided to the waste toner box 22 at the end of the process cartridge 21. The cooling air flowing in the direction of arrow C cools the waste toner box 22 as well as the entire process cartridge 21. As a result, the waste toner in the waste toner box 22 is cooled. The air that has cooled the entire process cartridge 21 is also discharged to the outside though the exhaust holes 1A, 1B, 1C of the main unit 1 (FIG. 1).

As described above, in this embodiment, cooling air is taken by the intake fan 61 from the outside to the inside of the main unit 1, and is delivered to the first duct 75 provided on the air blowing side of the intake fan 61 and the low-voltage power source 73.

The cooling air delivered to the low-voltage power source 73 cools the power source 73 to prevent the power source 73 from being overheated. The air delivered to the power source 73 becomes warm, and the air delivered to other portions also becomes warm, together they are discharged to the outside of the main unit 1. Accordingly, efficient cooling can be accomplished.

Meanwhile, the cooling air delivered to the first duct 75 efficiently flows into the second duct 77 and is enclosed by the planer portion 81 and the side walls 81*a*–81*c* of the first duct 75 without leaking to other portions of the image forming device.

Because the second duct 77 is closed at its end remotely from the first duct 75, the cooling air guided into the second duct 77 is only guided to mechanisms that need to be cooled. In particular, the cooling air is guided between the upper portion of the fixing unit 35 and the first auxiliary plate 57, through the midsection 83 and the left openings 85*a* in the left frame 85 of the second duct 77.

Thus, when the ambient temperature at the upper portion of the fixing unit 35 rises as the fixing unit 35 is heated, the heated air is discharged by the air flow in the direction of arrow A to the outside of the main unit 1. This prevents the ambient temperature at the upper portion of the fixing unit 35 from excessively rising. This also prevents the temperature in the drive motor 40 of the scanner unit 41 placed on the first auxiliary plate 57 from indirectly rising.

In addition, cooling air guided into the second duct 77 flows upward (in the direction of arrow B) through the top opening 83*a* of the midsection 83. The cooling air is guided to the underside of the bottom plate 41*a* of the mount of the drive motor 40 of the scanner unit 41 through the openings 57*b* in the first auxiliary plate 57. Thus, the cooling air flowing in the direction of arrow B intensively cools the drive motor 40 of the scanner unit 41. As a result, the life expectancy of the drive motor 40 will not be shortened. However, no air is guided into the scanner unit 41 because the scanner unit 41 contains high-precision components. If dust or foreign objects enter the scanner unit 41 or adhere to optical components, the scanner unit 41 becomes faulty or the precision laser scanning will be disabled.

In addition, cooling air guided into the second duct 77 is guided to the waste toner box 22 at one end of the process cartridge 21 (in the direction of arrow C) through the right openings 87*a* in the right frame 87. The cooling air cools the waste toner box 22 as well as the entire process cartridge 21. As a result, the waste toner in the waste toner box 22 is cooled.

This prevents the waste toner in the process cartridge 21 from being excessively heated, melted and fixed to the cleaning blade or the like. Accordingly, the waste toner cleaning ability can be maintained and the toner carrying surface of the photosensitive drum 23 will not be damaged. Additionally, because the toner is kept at an optimum temperature and is deposited accurately on the photosensitive drum 23, a high quality image can be formed.

As will be apparent from the above-described embodiment, because the duct 71 extends from the blowing side of the intake fan 61 to the other support frame 53 to form the air passage, the cooling air can be efficiently delivered to the upper portion of the fixing unit 35 and the scanner unit 41 disposed around the air passage.

In this embodiment, the inside diameter of the duct 71 is diminishing from the intake fan side to the other support frame side. Thus, the duct 71 can efficiently collect a large quantity of cooling air blown from the intake fan 61 and deliver the cooling air to portions as required.

In this embodiment, the cooling air is delivered to the upper portion of the fixing unit 35 through the left openings 85*a* in the side wall of the duct 71 to discharge the hot air at the upper portion of the fixing unit 35 to the outside of the main unit 1. Consequently, the temperature of the scanner unit 41 and the overall temperature in the main unit 1 drop.

In this embodiment, the cooling air is directly delivered to the scanner unit 41 through the top opening 83*a* in the side wall of the duct 71. This prevents the hot air at the upper portion of the fixing unit 35 from directly reaching the scanner unit 41. Consequently, the temperature of the scanner unit 41 can be lowered, and thus the life expectancy of the drive motor 40 can be prolonged. Additionally, thermal deterioration in dimensional accuracy of resin components, such as a optical lens holder, can be prevented.

In this embodiment, the scanner unit 41 is placed on the first auxiliary plate 57 and an opening is formed in the first auxiliary plate 57. Components of the scanner unit 41, particularly the drive motor 40, can be intensively cooled by the cooing air delivered through the opening.

In this embodiment, the cooling air is delivered to the process cartridge 21 through the right openings 87*a* in the side wall of the duct 71. This prevents the waste toner stored in the process cartridge 21 from being heated, melted, and fixed to somewhere in the process cartridge 21. Accordingly, the remaining toner on the photosensitive drum 23 can be reliably reclaimed, and a high-quality image can be formed.

In the embodiment, the left openings 85*a* and the right openings 87*a* are formed into slits, and these slits are provided perpendicularly to the duct extending direction. Accordingly, the cooling air can be efficiently delivered through the slits in targeted directions (toward mechanisms disposed around the duct 71).

In the embodiment, the duct 71 is closed at its end remotely from the intake fan 61. This prevents the cooling air from leaking uselessly and allows a large quantity of cooling air to be delivered in targeted directions through the slits and other openings provided on the side walls of the duct 71.

Further, in the embodiment, because half the blowing area of the intake fan 61 is facing the low-voltage power source 73, the power source 73 (the low-voltage power source for the drive motor 40), which gets hot when used, can be efficiently cooled.

Still further, in the embodiment, the air having been delivered to the power source 73, having absorbed heat therefrom, and having gone upward is discharged from the exhaust fan 65. This efficiently prevents the temperature in the main unit 1 from rising.

While the invention has been described with reference to a specific embodiment, the description of the embodiment is illustrative only and is not to be construed as limiting the scope of the invention. Various other modifications and changes may occur to those skilled in the art without departing from the spirit and scope of the invention.

What is claimed is:

1. An image forming device, comprising:

an optical mechanism that is disposed between a pair of support frames of the image forming device and has a drive motor that drives the optical mechanism to form an electrostatic latent image on a photosensitive body;

a developing mechanism that develops the electrostatic latent image on the photosensitive body using a developing agent;

a transfer mechanism that transfers the developed electrostatic latent image developed on the photosensitive body by the developing mechanism to a printing medium;

a thermal fixing mechanism that thermally fixes the developed electrostatic latent image transferred by the transfer mechanism onto the printing medium;

an intake fan that is provided for one of the pair of support frames and takes cooling air from an outside to an inside of the image forming device; and an air passage that guides the cooling air taken by the intake fan to an upper portion of the thermal fixing mechanism and to the optical mechanism, the air passage including a duct that forms the air passage extending from an air blowing side of the intake fan at one of the pair of support frames to the other one of the pair of support frames, the duct having a first opening in a side wall of the duct, wherein the cooling air is delivered to the upper portion of the thermal fixing mechanism through the first opening.

2. The image forming device according to claim 1, wherein an inside diameter of the duct is diminishing toward the other support frame.

3. The image forming device according to claim 1, further comprising a second opening in a side wall of the duct, wherein the cooling air is delivered to the optical mechanism through the second opening.

4. The image forming device according to claim 3, further comprising an auxiliary plate that supports the optical mechanism and covers the second opening, wherein the cooling air is delivered to the drive motor of the optical mechanism through an opening formed in the auxiliary plate.

5. The image forming device according to claim 4, further comprising a process cartridge detachably attached to the image forming device and having the developing agent, the developing mechanism, and the photosensitive body, and a third opening in the side wall of the duct, wherein the cooling air is delivered to the process cartridge through the third opening.

6. The image forming device according to claim 5, wherein any one of the first, second, and third openings is a slit formed perpendicularly to a duct extending direction.

7. The image forming device according to claim 1, wherein the duct is closed at its end coupled to the other support frame.

8. The image forming device according to claim 1, further comprising a power source that drives the drive motor, wherein a cooling air guiding end of the duct is aligned with approximate half of an air blowing area of the intake fan, and the power source is exposed to the remaining half of the blowing area.

9. The image forming device according to claim 8, further comprising an exhaust fan that is provided for the other support frame adjacent to the power source, the exhaust fan discharges the cooling air delivered by the intake fan to the power source to the outside of the image forming device.

10. A duct through which cooling air from an air blower is delivered to at least one high-temperature portion within an electronic device, the duct comprising:

an air collecting member that is disposed in the electronic device to face the air blower and collects the cooling air; and a conveying member that is coupled to the air collecting member and conveys the cooling air, the conveying member having at least one opening opposed to the at least one high-temperature portion, wherein the conveying member is shaped like a trough of approximately U-shape in cross section, an upper portion of the conveying member being covered by a holder that supports the at least one high-temperature portion, and the conveying member being closed at its end remotely from the air collecting member.

11. The duct according to claim 10, wherein the conveying member has at least one side surface formed with the at least one opening through which the cooling air is conveyed to the at least one high-temperature portion opposed to the at least one side surface.

12. A duct through which cooling air from an air blower is delivered to at least one high temperature portion within an electronic device, the duct comprising:

an air collecting member that is disposed in the electronic device to face the air blower and collects the cooling air; and a conveying member that is coupled to the air collecting member and conveys the cooling air, the conveying member having at least one opening opposed to the at least one high temperature portion, wherein the at least one high temperature portion includes two high temperature portions, and the conveying member has two side surfaces, each side surface being formed with the at least one opening through which the cooling air is conveyed to the two high temperature portions opposed to the two side surfaces.

13. A cooling mechanism that delivers cooling air to a high-temperature portion within an electronic device, the cooling mechanism comprising:

an air blower that is provided in the electronic device blows the cooling air from an outside to an inside of the electronic device;

an air collecting member that is disposed in the electronic device to face the air blower collects the cooling air;

a conveying member that is coupled to the air collecting member conveys the cooling air, the conveying member being shaped like a trough of approximate U-shape in cross section; and a holder that supports the high-temperature portion covers an upper opening of the conveying member, the holder has at least one opening through which the cooling air is delivered to the high-temperature portion.

14. A cooling mechanism that delivers cooling air to a high-temperature portion within an electronic device, the cooling mechanism comprising:

an air blower that is provided in the electronic device and blows the cooling air from an outside to an inside of the electronic device;

an air collecting member that is disposed in the electronic device to face the air blower and collects the cooling air; and a conveying member that is coupled to the air collecting member and conveys the cooling air, the conveying member having at least one side surface, the at least one side surface being formed with at least one opening through which the cooling air is conveyed to the high-temperature portion opposed to the at least one side surface, wherein the high temperature portion includes two high temperature portions, and the conveying member has two side surfaces, each side surface being formed with the at least one opening through which the cooling air is conveyed to the two high temperature portions opposed to the two side surfaces.

* * * * *